US006540270B1

(12) United States Patent
Reddmann

(10) Patent No.: US 6,540,270 B1
(45) Date of Patent: Apr. 1, 2003

(54) POWER CLOSER FOR MOTOR-VEHICLE DOOR LATCH

(75) Inventor: Uwe Reddmann, Essen (DE)

(73) Assignee: Kiekert AG, Heiligenhaus (DE)

( * ) Notice: Subject to any disclaimer, the term of this patent is extended or adjusted under 35 U.S.C. 154(b) by 40 days.

(21) Appl. No.: 09/716,827

(22) Filed: Nov. 20, 2000

(30) Foreign Application Priority Data

Nov. 20, 1999 (DE) ..... 199 55 883

(51) Int. Cl.[7] ..... E05C 3/06

(52) U.S. Cl. ..... 292/201; 292/216; 292/279; 292/280; 292/DIG. 23; 292/DIG. 24

(58) Field of Search ..... 292/216, 201, 292/DIG. 24, DIG. 23, 341.16; 49/279, 280

(56) References Cited

U.S. PATENT DOCUMENTS

| | | | | | |
|---|---|---|---|---|---|
| 3,422,572 | A | * | 1/1969 | Pollak | 49/280 |
| 4,569,544 | A | * | 2/1986 | Escaravage | 292/216 |
| 4,664,430 | A | * | 5/1987 | Bernard | 292/201 |
| 4,707,007 | A | * | 11/1987 | Inoh | 292/341.16 |
| 5,004,280 | A | * | 4/1991 | Schap | 292/341.16 |
| 5,240,296 | A | * | 8/1993 | Kobayashi | 292/201 |
| 5,765,886 | A | * | 6/1998 | Buchanan | 292/341.16 |
| 5,921,594 | A | * | 7/1999 | Bendel | 292/216 |
| 5,934,717 | A | * | 8/1999 | Wirths et al. | 292/201 |

FOREIGN PATENT DOCUMENTS

| | | | | |
|---|---|---|---|---|
| DE | 34 01 842 | | 8/1985 | |
| DE | 37 21 963 | | 10/1988 | |
| DE | 42 10 893 | | 10/1993 | |
| DE | 44 10 712 | | 10/1994 | |
| DE | 19710531 | A1 * | 9/1998 | 292/341.16 |
| DE | 19961247 | A1 * | 8/2000 | 292/341.16 |

* cited by examiner

*Primary Examiner*—J. J. Swann
*Assistant Examiner*—Carlos Lugo
(74) *Attorney, Agent, or Firm*—Herbert Dubno

(57) ABSTRACT

A power-closing motor-vehicle latch-bolt assembly has a housing, an elongated rocker having inner and outer ends, and a pivot at the inner end connecting the rocker to the housing for pivoting about an axis passing through the inner end. A drive engageable with the outer end pivots the rocker about the axis. A door bolt fixed to and projecting from the rocker is engageable with a door-mounted fork. The bolt projects from the rocker between the ends thereof. The housing is formed with a slot through which the bolt projects and along which the bolt travels when the rocker is pivoted about the axis. Furthermore the housing is provided with a guide pin extending parallel to the axis offset from the pivot. The rocker is formed with an arcuate slot through which the guide pin extends and along which it travels when the rocker is pivoted about the axis.

11 Claims, 3 Drawing Sheets

POWER CLOSER FOR MOTOR-VEHICLE DOOR LATCH

FIELD OF THE INVENTION

The present invention relates to a motor-vehicle door latch. More particularly this invention concerns a power closer that shifts a door bolt to pull in a door after it has been latched shut.

BACKGROUND OF THE INVENTION

A motor vehicle door is normally provided on its outer edge opposite its hinged edge with a latch having an element typically formed as a fork engageable around a bolt projecting from a door post. The fork can retain the bolt in the latch housing to hold the door closed, and can slide or pivot to release the bolt and allow the door to be opened. On closing the fork is automatically engaged and latches the door which engages in the door opening against an annular seal typically carried on the vehicle body.

In today's vehicles it is important that the door be as tightly closed as possible, in order to reduce drafts and noise. Thus the door should, in the closed position, exert the maximum possible compression on the door seal. This effect is most simply achieved by simply only letting the latch engage in its end position when the door is forcibly closed, requiring the user to pull or push it solidly to.

Better vehicles incorporate a power-closing system which, once the fork has latched around the bolt, displace the bolt inward through a short extra stroke that ensures that the door will be tightly closed. The system is also normally set to move the bolt outward through its stroke when one of the latches is initially actuated to open the door. In this manner the user is not burdened with having to close a door very tightly, or deal with opening a very tightly closed door. In practice such a system allows a door to be pulled much more tightly closed than could normally be expected by a standard system. These arrangements are particularly usable on the trunk door as they allow the user to merely push the door to and thereafter it will fully close by its own automatic operation.

These power closing systems work various ways. In U.S. patent application Ser. No. 09/338,036 filed Jun. 22, 1999 and in German patent document 4,210,893 published Oct. 7, 1993 for P. Szablewski the bolt is mounted slightly eccentrically on a rotary mount that is driven by an electric motor through a step-down transmission. These systems have the disadvantage that the bolt moves the same distance crosswise to the closing direction as parallel to this direction, so that the door will move vertically somewhat as it closes. It is preferred that this movement be substantially only in a direction perpendicular to the seal so that the door fits snugly without undue wear to the seal and other parts.

In German patent 3,721,963 issued Oct. 13, 1988 to K. Raffelseifer the bolt is mounted on a pair of crank arms and is pushed by a lever operated by an eccentric drive. German patent document 3,401,842 published Aug. 1, 1985 describes a system where the bolt is mounted on a carriage fixed to a flexible element that is payed in and out to advance and retract it. The bolt in German patent document 4,410,712 published Oct. 13, 1994 for D. Sack is mounted on a carriage that is carried on a threaded spindle fixed in the door post so that rotation of the spindle advances and retracts the bolt carriage. All of these systems are relatively expensive and some are quite bulky. As the item is intended for mass production and must have a long service life, it must be as rugged and simple as possible.

OBJECTS OF THE INVENTION

It is therefore an object of the present invention to provide an improved power closer for a motor-vehicle door latch.

Another object is the provision of such an improved power closer for a motor-vehicle door latch which overcomes the above-given disadvantages, that is which is of very simple and robust construction.

A further object is to provide such a simple and robust power closer whose bolt moves in a generally straight line.

SUMMARY OF THE INVENTION

A power-closing motor-vehicle latch-bolt assembly has according to the invention a housing, an elongated rocker having inner and outer ends, and a pivot at the inner end connecting the rocker to the housing for pivoting about an axis passing through the inner end. A drive engageable with the outer end pivots the rocker about the axis. A door bolt fixed to and projecting from, the rocker is engageable with a door-mounted fork. The bolt projects from the rocker between the ends thereof.

This structure is extremely simple and rugged. Nonetheless the bolt moves in an essentially straight line as the rocker pivots so there will be no significant vertical movement of the door, unlock the prior art systems where the bolt pivoted about an axis lying within its outline so that the vertical component of its travel was the same as its horizontal component.

The housing is formed with a slot through which the bolt projects and along which the bolt travels when the rocker is pivoted about the axis. Furthermore the housing is provided with a guide pin extending parallel to the axis offset from the pivot. The rocker is formed with an arcuate slot through which the guide pin extends and along which it travels when the rocker is pivoted about the axis.

The bolt according to the invention is between the guide pin and the pivot. In addition the guide pin has an enlarged head and the rocker lying between the enlarged head and the housing where the pin is fixed. A spring urges the rocker pivotally into an outer end position and against the drive. This spring engages the outer end of the rocker.

The drive includes a motor having an output, a wheel rotatable about a wheel axis parallel to the pivot axis, an eccentric element carried on the wheel and engageable radially of the wheel axis with the outer end of the rocker, and step-down gearing between the motor output and the wheel. The step-down gearing includes at least one worm gear meshing with a toothed periphery of the wheel. A switch actuatable by the rocker in an end position thereof reports the position of the door to an onboard computer.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
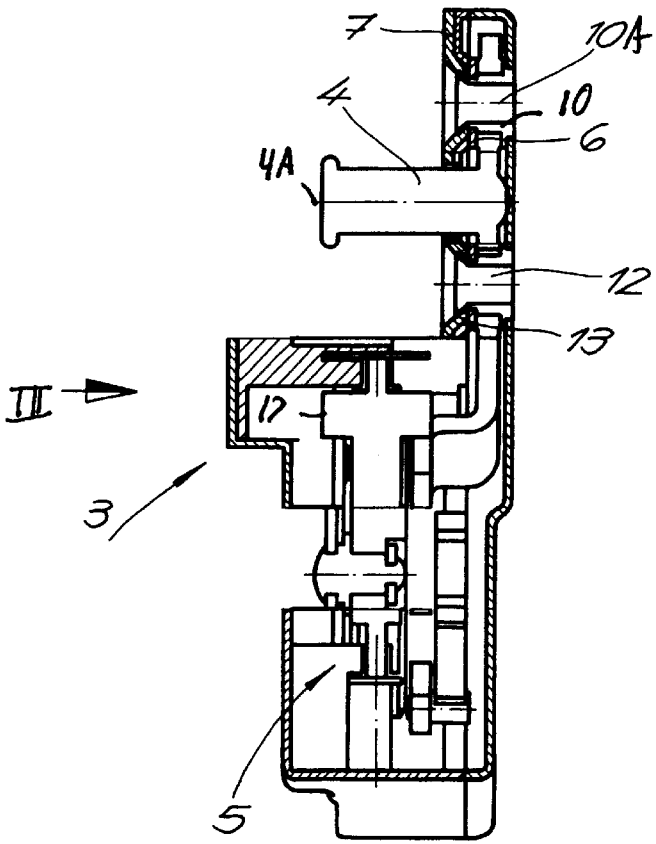
FIG. 2 is a section taken along line II—II of FIG. 1.
Figure 1:
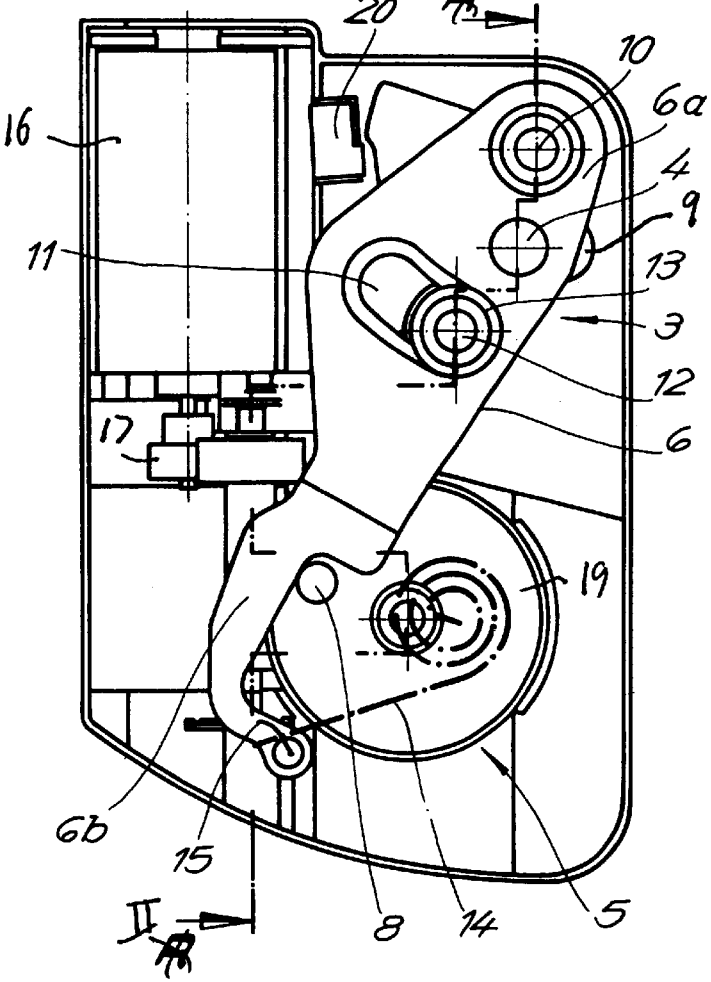
FIG. 1 is a side view of the power latch closer according to the invention.
Figure 4:
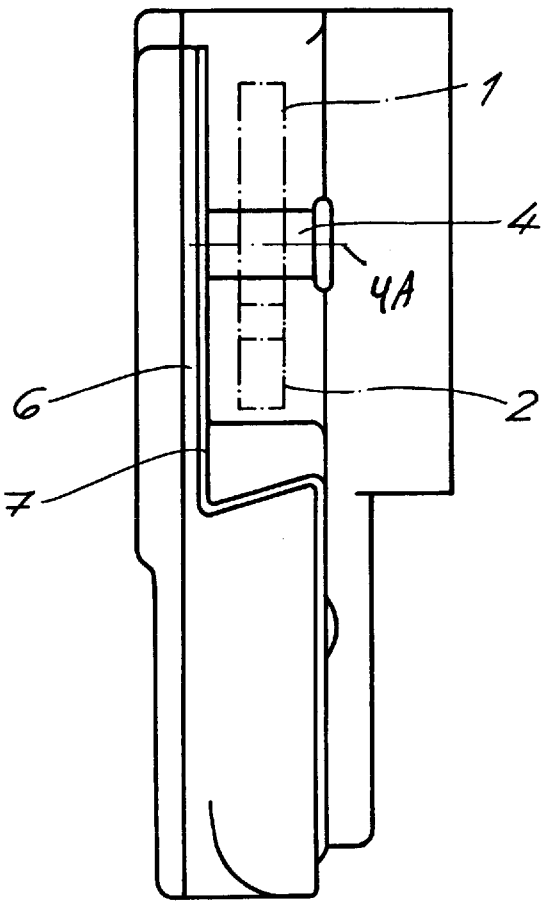
FIG. 4 is a view taken in the direction of arrow IV of FIG. 3.
Figure 3:
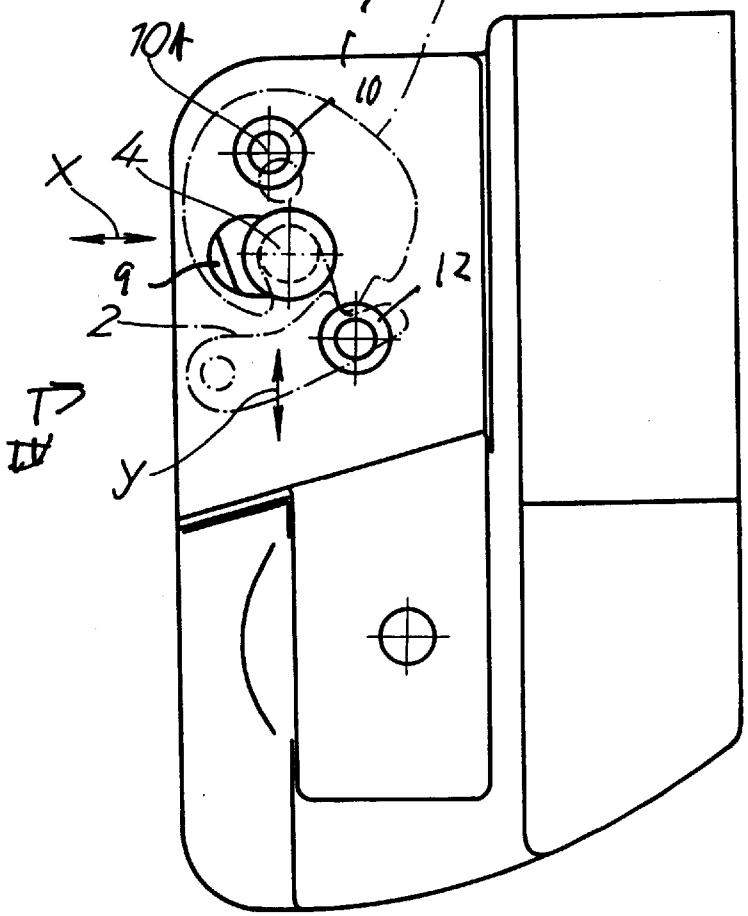
FIG. 3 is a view taken in the direction of arrow III of FIG. 2.

As seen in FIGS. 3 and 4 a standard latching fork 1 can be retained in a holding position by a pawl 2 carried, like the fork 1, on an unillustrated motor-vehicle door. The fork 1 is engageable around a bolt 4 extending along an axis 4A from a bolt assembly 3 which is pivotal in a housing 7 fixed to an unillustrated door post and which is operated by a drive 5. FIGS. 1 and 2 show how the bolt 4 can be displaced by this drive 5 in a horizontal direction x perpendicular to the axis A and parallel to the direction of movement of the fork 1 and pawl 2 when the door carrying them is closed and opened.

The bolt assembly 3 also includes a rocker plate 6 to which the bolt 4 is fixed and which has an end 6*a* pivotal on a hollow rivet 10 at an axis 10A parallel to the axis 4A and an opposite end 6*b* operated by a drive 5. The bolt 4 projects through a slot 9 cut in the housing 7 and extending generally parallel to the direction x. The hollow rivet 10 serves as a mounting hole for bolting of the housing 7 to the door post so that the very location of the pivot for the rocker plate 6 is solidly fixed.

Figure 5:
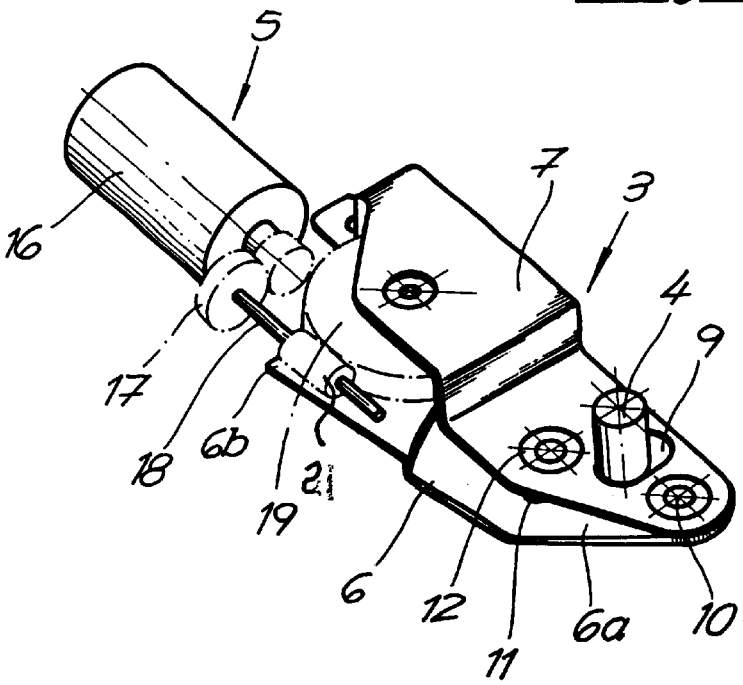
FIGS. 5 and 6 are perspective views of the actuator assembly of the apparatus of the invention.
Figure 6:
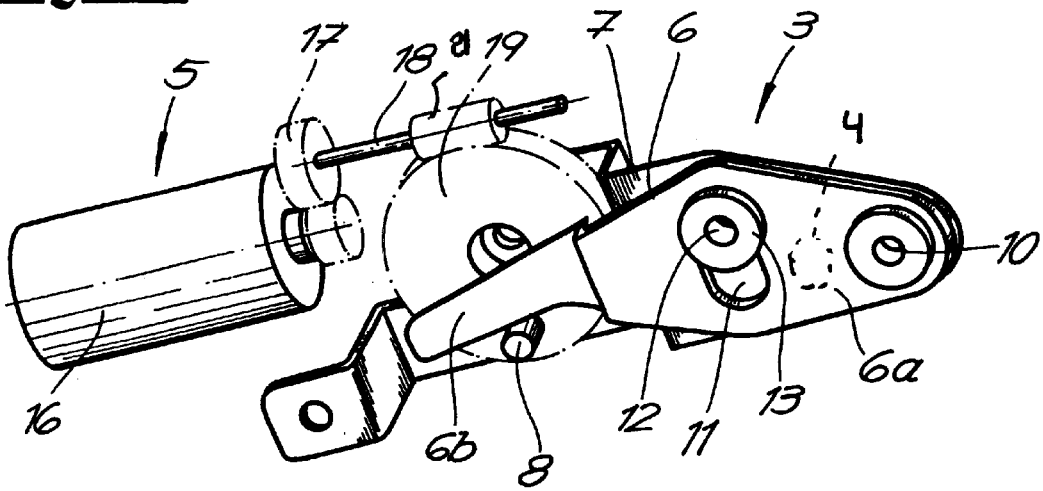

The drive 5 comprises as best shown in FIGS. 5 and 6 an electric motor 16 whose output is connected through a first step-down gear train 17 to a shaft 18 carrying a worm gear 21 meshing with the toothed outer periphery of a wheel 19 rotatable about an axis 19A parallel to the axes 4A and 10A and carrying an eccentric pin 8 engageable with the plate end 6*b*. A spiral torque spring 14 continuously biases a pin 15 on the outer end 6*b* of the rocker plate 6 outward in direction x, that is to the right in FIG. 1 and left in FIG. 3, so that the plate 6 normally bears on the eccentric drive element 8. The orbit of the pin 8 is such that at diametrically opposite positions of the pin 8 the rocker 8 is in its end positions, ensuring perfectly logarithmic acceleration from and deceleration to these end positions. What is more the motor can be deenergized in these positions and the simple drag of the long step-down gear train from the motor 16 to the wheel 19 will ensure that the wheel 19 will not rotate and allow the door connected to the fork 1 to open.

A stabilizing or guide pin 12 also formed like the rivet 10 as a hollow bolt or rivet through which the housing 7 is bolted to the door post has an enlarged head 13 riding on the inner face of the plate 6 and passes through an arcuate slot 11 centered on the axis 10A. The bolt 4 is fixed to the rocker plate 6 between the pins 10 and 12 which hold and guide this plate 6 so that the pivotal bolt assembly 3 is very solidly mounted and the bolt 4 will not tip.

A microswitch 20 mounted in the housing 7 can be operated by the rocker 6 to report to an onboard computer that the door is fully closed. This switch 20 also serves for shutting off the motor 16 when the fully closed position is reached. Another such switch is tripped when the bolt 4 is initially engaged by the fork 1 to initiate the power-closing operation.

The bolt 4 is spaced about 20 mm from the axis 10A and its stroke in the horizontal direction x is about 8 mm so that its vertical movement in the direction y is very small, at most about 0.4 mm. The triple step-down of the motor output, effected first by the gear train 17, second by the worm gear 21, and third by the orbital travel of the pin 8, ensures that even a relatively small motor 16 can displace the bolt 4 with great force.

I claim:

1. In combination with a latch fork, a power-closing motor-vehicle latch-bolt assembly comprising:

a housing;

an elongated rocker having inner and outer ends;

a pivot at the inner end connecting the rocker to the housing for pivoting about an axis passing through the inner end;

drive means engageable at a location with the outer end for pivoting the rocker about the axis; and a door bolt fixed to and projecting from the rocker between the inner-end axis and the outer-end location and engageable with the fork.

2. The latch-bolt assembly defined in claim 1, wherein the housing is formed with a slot through which the bolt projects and along which the bolt travels when the rocker is pivoted about the axis.

3. The latch-bolt assembly defined in claim 1, further comprising a spring urging the rocker pivotally into an outer end position and against the drive means.

4. The latch-bolt assembly defined in claim 3, wherein the spring engages the outer end of the rocker.

5. The latch-bolt assembly defined in claim 1, wherein the drive means includes a motor having an output, a wheel rotatable about a wheel axis parallel to the pivot axis, an eccentric element carried on the wheel and engageable radially of the wheel axis with the outer end of the rocker, and step-down gearing between the motor output and the wheel.

6. The latch-bolt assembly defined in claim 5, wherein the step-down gearing includes at least one worm gear meshing with a toothed periphery of the wheel.

7. The latch-bolt assembly defined in claim 1, further comprising

A switch actuatable by the rocker in an end position thereof.

8. The latch-bolt assembly defined in claim 1, wherein the bolt is offset by about 20 mm from the pivot.

9. In combination with a latch fork, a power-closing motor-vehicle latch-bolt assembly comprising:

a housing;

an elongated rocker having inner and outer ends;

a pivot at the inner end connecting the rocker to the housing for pivoting about an axis passing through the inner end;

drive means engageable with the outer end for pivoting the rocker about the axis;

a door bolt fixed to and projecting from the rocker and engageable with the fork; and a guide pin fixed on the housing and extending parallel to the axis offset from the pivot, the rocker being formed with an arcuate slot through which the guide pin extends and along which it travels when the rocker is pivoted about the axis.

10. The latch-bolt assembly defined in claim 9, wherein the bolt is between the guide pin and the pivot.

11. The latch-bolt assembly defined in claim 9, wherein the guide pin has an enlarged head, the rocker lying between the enlarged head and the housing where the pin is fixed.

* * * * *